US006390035B2

(12) United States Patent
Moteki et al.

(10) Patent No.: US 6,390,035 B2
(45) Date of Patent: May 21, 2002

(54) RECIPROCATING INTERNAL COMBUSTION ENGINE

(75) Inventors: Katsuya Moteki, Tokyo; Takayuki Arai, Yokohama; Hiroya Fujimoto, Kanagawa, all of (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 09/784,137

(22) Filed: Feb. 16, 2001

(30) Foreign Application Priority Data

Feb. 16, 2000 (JP) ..... 2000-037380

(51) Int. Cl.[7] ..... F02B 75/32
(52) U.S. Cl. ..... 123/78 BA; 123/78 F
(58) Field of Search ..... 123/78 BA, 78 E, 123/78 F, 78 R

(56) References Cited

U.S. PATENT DOCUMENTS 4,437,438 A * 3/1984 Mederer ..... 123/78 E
4,538,557 A * 9/1985 Kleiner et al. ..... 123/78 E
5,398,652 A * 3/1995 Jackson ..... 123/78 E
6,009,845 A * 1/2000 Ehrlich ..... 123/78 E
6,125,802 A * 10/2000 Pen ..... 123/78 E
6,202,623 B1 * 3/2001 Ehrlich ..... 123/78 E

* cited by examiner

*Primary Examiner*—Paul J. Hirsch
(74) *Attorney, Agent, or Firm*—Foley & Lardner

(57) ABSTRACT

A variable compression-ratio, multiple-link type reciprocating internal combustion engine has at least three links, namely an upper link, a lower link and a third link, for each engine cylinder. The upper link is connected to a piston pin, the lower link connects the upper link to a crank pin, and the third link is pivoted at one end to a body of the engine and connected at its other end to either of the upper and lower links to permit oscillating motion of the third link on the engine body. The upper link, the lower link, and the third link are dimensioned and laid out, so that the amplitude of a second-order vibration component of a vibrating system of reciprocating motion of the piston, synchronizing rotary motion of the crankshaft, is suppressed and reduced to below a predetermined threshold value, while realizing the same piston stroke and engine-cylinder height as a single-link type reciprocating internal combustion engine in which a piston pin and a crank pin are connected to each other by a single link.

17 Claims, 9 Drawing Sheets

PISTON ACCELERATION AT HIGH COMPRESSION RATIO &
AMPLITUDE OF EACH OF ACCELERATION COMPONENTS
HAVING DIFFERENT ORDERS

PISTON ACCELERATION AT LOW COMPRESSION RATIO & AMPLITUDE OF EACH OF ACCELERATION COMPONENTS HAVING DIFFERENT ORDERS

PISTON ACCELERATION & AMPLITUDE OF EACH OF ACCELERATION COMPONENTS HAVING DIFFERENT ORDERS IN SINGLE-LINK TYPE RECIPROCATING ENGINE

RECIPROCATING INTERNAL COMBUSTION ENGINE

TECHNICAL FIELD

The present invention relates to a reciprocating internal combustion engine suitable for automotive vehicles, and particularly to the improvements of an internal combustion engine having reciprocating pistons, each connected to an engine crankshaft via a linkage.

BACKGROUND ART

In typical reciprocating internal combustion engines, a crank pin of a crankshaft is connected to a piston pin of a piston usually by means of a single link known as a "connecting rod". The internal combustion engine having reciprocating pistons each connected to the crankshaft via the single link (connecting rod) will be hereinafter referred to as a "single-link type reciprocating piston engine". In the single-link type reciprocating engines, the length of the connecting rod is finite, and therefore higher-order vibration (oscillation) components except a first-order vibration component are involved in a vibrating system of reciprocating motion of the piston, synchronizing rotary motion of the crankshaft. In order to vary a compression ratio between the volume in the engine cylinder with the piston at bottom dead center (BDC) and the volume with the piston at top dead center (TDC) depending upon engine operating conditions such as engine speed, in recent years, there have been proposed multiple-link type reciprocating engines. One such multiple-link type reciprocating engine has been disclosed in Japanese Patent Provisional Publication No. 9-228858.

SUMMARY OF THE INVENTION

Referring to FIG. 9, there are shown variations in the piston acceleration (indicated by the heavy solid line in FIG. 9) and fluctuations in each of piston accelerations having different orders, that is, the amplitude of each of 1st-order, 2nd-order, 3rd-order, and 4th-order vibration components, in a single-link type reciprocating piston engine. In FIG. 9, the thin solid line indicates the change in the first-order piston acceleration corresponding to the first-order vibration component of the vibrating system of reciprocating motion of the piston, synchronizing rotary motion of the crankshaft. The broken line shown in FIG. 9 indicates the change in the second-order piston acceleration corresponding to the second-order vibration component of the vibrating system of reciprocating motion of the piston. The one-dotted line shown in FIG. 9 indicates the change in the third-order piston acceleration corresponding to the third-order vibration component of the vibrating system of reciprocating motion of the piston, whereas the two-dotted line shown in FIG. 9 indicates the change in the fourth-order piston acceleration corresponding to the fourth-order vibration component of the vibrating system of reciprocating motion of the piston. As can be seen from the graph shown in FIG. 9, in the single-link type reciprocating piston engine, in addition to the first-order piston-acceleration component (see the thin solid line of the characteristic curve shown in FIG. 9), the second-order piston-acceleration component (see the broken line of the characteristic curve shown in FIG. 9) is involved in the vibrating system of reciprocating motion of the piston. As clearly seen from the characteristic curves shown in FIG. 9, the amplitude of the second-order piston-acceleration component is relatively large in comparison with the third-order and fourth-order piston-acceleration components. Actually, the amplitude of the second-order piston-acceleration component is about one third the first-order piston-acceleration component. For the reasons set forth above, in the single-link type reciprocating engine, a vibrating force, occurring mainly owing to the first-order and second-order vibration components, acts on the engine, in particular the engine block. By providing counter weights or balance weights, each located opposite to its adjacent crank pin of the crankshaft, it is possible to effectively reduce or suppress the first-order vibration occurring due to the first-order vibration component of the vibrating system of reciprocating piston, synchronizing rotary motion of the crankshaft. In multiple cylinder engines, by way of contriving of the layout of cylinders, it is possible to satisfactorily suppress the first-order vibration. In comparison with the first-order vibration, it is difficult to sufficiently suppress the second-order vibration occurring due to the second-order vibration component of the vibrating system of reciprocating piston, synchronizing rotary motion of the crankshaft, by way of only the layout of cylinders. Generally, booming noise occurring in the vehicle compartment is caused by such second-order vibrations. The longer the length of the connecting rod, the smaller the amplitudes of the first-order and higher-order vibration components and, hence, the vibrating system of reciprocating motion of the piston can approach to a simple harmonic vibration that vibration at a point in a system is simple harmonic when the displacement with respect to time is described by a simple sine function. On one hand, the longer connecting rod contributes to a reduction in the second-order piston-acceleration component, but, on the other hand, the longer connecting rod increases the overall height of the engine, thereby resulting in an increase in total weight of the engine and preventing easy mounting of the engine on the vehicle engine mount.

Accordingly, it is an object of the invention to provide an improved reciprocating internal combustion engine, which avoids the aforementioned disadvantages.

It is another object of the invention to provide a multiple-link type reciprocating engine, which is capable of effectively reducing a second-order vibration component of a vibrating system of reciprocating motion of each of pistons, synchronizing rotary motion of a crankshaft, without increasing the overall height of the engine, by properly setting dimensions, shapes, layout and relative positions of links via which a crank pin of the crankshaft is connected to a piston pin of each piston.

In order to accomplish the aforementioned and other objects of the present invention, a multiple-link type reciprocating internal combustion engine comprises a piston movable through a stroke in the engine and having a piston pin, a crankshaft changing reciprocating motion of the piston into rotating motion and having a crank pin, a linkage comprising an upper link connected to the piston pin, a lower link connecting the upper link to the crank pin, and a third link pivoted at one end to a body of the engine and connected at its other end to either of the upper and lower links to permit oscillating motion of the third link on the body of the engine, and the upper link, the lower link, and the third link being dimensioned and laid out so that an amplitude of a second-order vibration component of a vibrating system of reciprocating motion of the piston, synchronizing rotary motion of the crankshaft, is reduced to below a predetermined threshold value. It is preferable that the predetermined threshold value of the amplitude of the second-order vibration component is set to be less than or equal to 10% of an amplitude of a first-order vibration component of the vibrating system of reciprocating motion of the piston, synchronizing rotary motion of the crankshaft.

According to another aspect of the invention, a multiple-link type reciprocating internal combustion engine comprises a piston movable through a stroke in the engine and having a piston pin, a crankshaft changing reciprocating motion of the piston into rotating motion and having a crank pin, a linkage comprising an upper link connected to the piston pin, a lower link connecting the upper link to the crank pin, and a third link pivoted at one end to a body of the engine and connected at its other end to either of the upper and lower links to permit oscillating motion of the third link on the body of the engine, and the upper link, the lower link, and the third link being dimensioned and laid out so that an amplitude of a second-order vibration component of a vibrating system of reciprocating motion of the piston, synchronizing rotary motion of the crankshaft, is generally equal to an amplitude of a third-order vibration component of the vibrating system. Preferably, a pivot of oscillating motion of the third link is displaceable with respect to the body of the engine, to vary a compression ratio of the engine. More preferably, the amplitude of the second-order vibration component of the vibrating system of reciprocating motion of the piston, produced when the pivot of the third link is kept at an angular position corresponding to a first compression ratio, is set to be less than the amplitude of the second-order vibration component of the vibrating system of reciprocating motion of the piston, produced when the pivot of the third link is kept at an angular position corresponding to a second compression ratio less than the first compression ratio. It is preferable that a distance from an axis of the crank pin to a trace line of reciprocating motion of an axis of the piston pin is shorter than a distance from a pivot of oscillating motion of the third link to the trace line of reciprocating motion of the axis of the piston pin, at least when the piston is near either of TDC and BDC. When a center of rotation of the crankshaft is defined as an origin O, a directed line Ox parallel to a direction perpendicular to the piston pin and a trace line of reciprocating motion of an axis of the piston pin as viewed from a direction of the axis of the piston pin is taken as an x-axis, a directed line Oy parallel to the trace line of reciprocating motion of the axis of the piston pin is taken as a y-axis, the directed lines Ox and Oy intersecting at a right angle at the origin O, and a direction of rotation of the crankshaft is defined as a counterclockwise direction as viewed from a front end of the engine, preferably, an x-coordinate of a pivot of oscillating motion of the third link is set to a positive value and an x-coordinate of the trace line of reciprocating motion of the axis of the piston pin is set to a negative value. More preferably, the multiple-link type reciprocating internal combustion engine may further comprise a first connecting portion via which the lower link and the third link are connected to each other to permit relative rotation of the lower link about an axis of the first connecting portion and relative rotation of the third link about the axis of the first connecting portion and a second connecting portion via which the upper link and the lower link are connected to each other to permit relative rotation of the upper link about an axis of the second connecting portion and relative rotation of the lower link about the axis of the second connecting portion, and it is preferable that the upper link, the lower link, and the third link are dimensioned and laid out, to satisfy a predetermined ratio $$L1:L2:L3:L4:L5:L6:XC:YC:x4 \approx$$

$$1:2.4:2.65 \sim 3.5:0.69:3.0 \sim 3.4:3.3 \sim 3.55:3.2 \sim 3.55: -2 \sim -1.35: -1 \sim -0.6$$

where L1 is a distance between the center of rotation of the crankshaft and an axis of the crank pin, L2 is a distance between the axis of the crank pin and an axis of the first connecting portion, L3 is a length of the third link, L4 is a distance between the axis of the crank pin and an axis of the second connecting portion, L5 is a distance between the axes of the first and second connecting portions, L6 is a length of the upper link, (XC, YC) are coordinates of the pivot of oscillating motion of the third link, and x4 is the x-coordinate of the trace line of reciprocating motion of the axis of the piston pin.

According to a still further aspect of the invention, a multiple-link type reciprocating internal combustion engine comprises a piston movable through a stroke in the engine and having a piston pin, a crankshaft changing reciprocating motion of the piston into rotating motion and having a crank pin, a linkage comprising an upper link connected to the piston pin, a lower link connecting the upper link to the crank pin, and a third link pivoted at one end to a body of the engine and connected at its other end to either of the upper and lower links to permit oscillating motion of the third link on the body of the engine, and the upper link, the lower link, and the third link being dimensioned and laid out so that an amplitude of a second-order vibration component of a vibrating system of reciprocating motion of the piston, synchronizing rotary motion of the crankshaft, is reduced to below a predetermined threshold value, while realizing the same piston stroke and engine-cylinder height as a single-link type reciprocating internal combustion engine in which a piston pin and a crank pin are connected to each other by a single link.

The other objects and features of this invention will become understood from the following description with reference to the accompanying drawings.

DESCRIPTION OF THE PREFERRED EMBODIMENTS

Figure 1B:
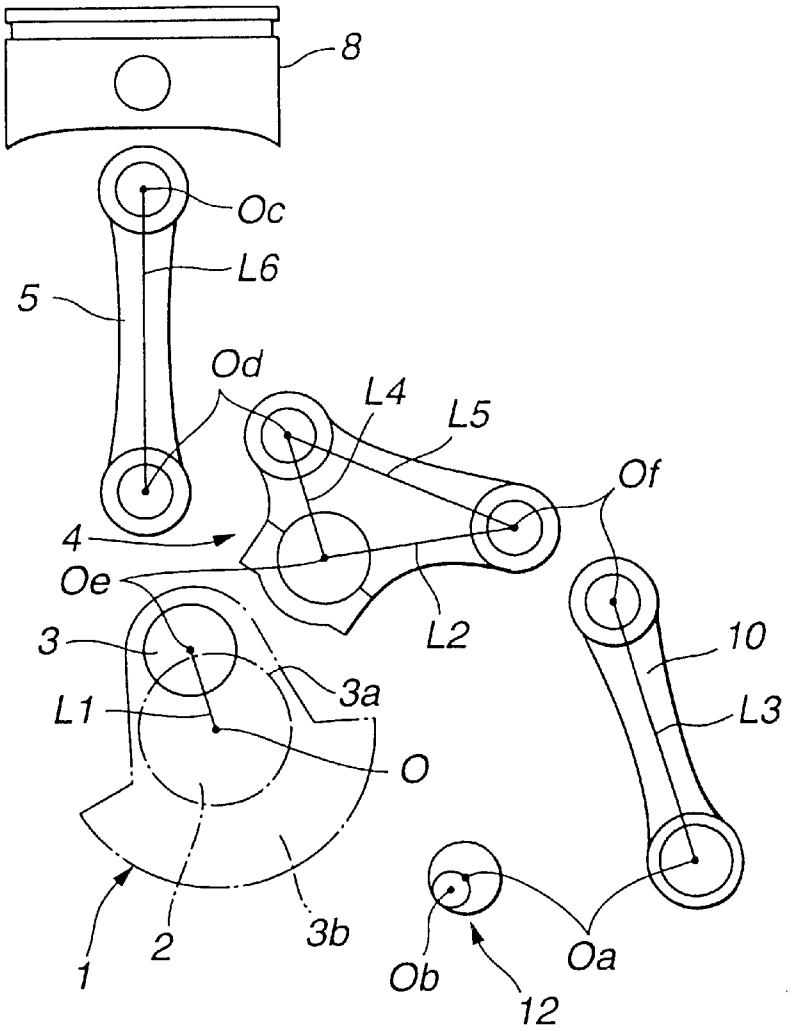
FIG. 1B is a disassembled view illustrating the multiple-link type reciprocating engine of the embodiment, wherein three links (5, 4, 10) are disconnected from each other.
Figure 1A:
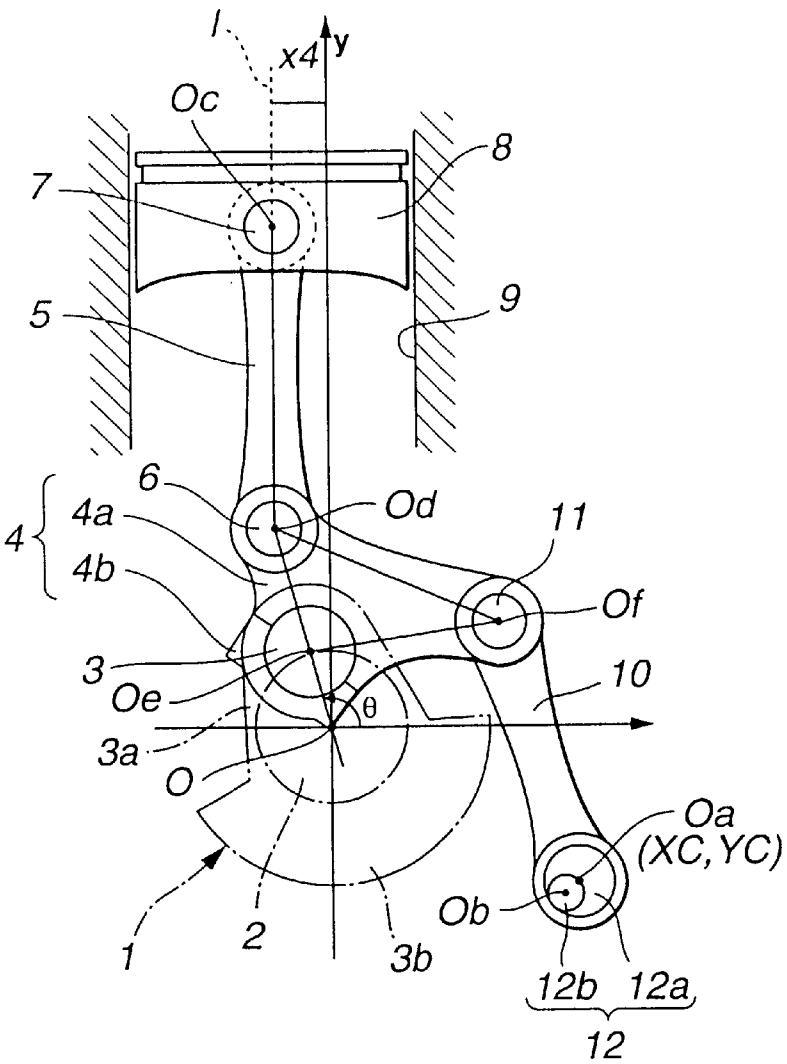
FIG. 1A is an assembled view illustrating an embodiment of a multiple-link type reciprocating internal combustion engine of the invention.

Referring now to the drawings, particularly to FIGS. 1A and 1B, a multiple-link type reciprocating engine of the invention is exemplified in an internal combustion engine having reciprocating pistons 8 each connected to an engine crankshaft 1 via a linkage composed of three links, namely an upper link 5, a lower link 4, and a control link 10. As shown in FIG. 1A, a crank journal (or a main bearing journal) 2 of crankshaft 1 is provided for each engine cylinder. Crank journals 2 are rotatably supported by means of main bearings (not shown) and main bearing caps (not shown) which are attached to an engine cylinder block (not shown) by cap screws. The axis O of each of crank journals 2 is identical to the axis (the rotation center) of crankshaft 1. The crank journals construct the rotating shaft portion of crankshaft 1 in contact with the main bearings. Crankshaft 1 has a crank pin 3, a crank arm (or a crank throw) 3*a*, and a counterweight 3*b*, for each engine cylinder 9 formed in an engine block. The axis of crank pin 3 is eccentric to the axis O of each crank journal 2. Crank pin 3 is connected via crank arm (or crank throw) 3*a* to crank journal 2. Counterweight 3*b* is located opposite to the crank pin with respect to the axis of the crank journal for attenuating the first-order vibration component of the vibrating system of reciprocating piston motion, synchronizing rotary motion of the crankshaft. In the shown embodiment, crank arm 3*a* and counterweight 3*b* are integrally formed with each other. Reciprocating pistons 8 are slidably fitted into the respective cylinders 9. In the multiple-link type reciprocating engine of the embodiment, the reciprocating piston and the crank pin are mechanically linked to each other by means of a plurality of links, namely upper and lower links 5 and 4. The upper end of upper link 5 is attached to or fitted onto a piston pin 7 fixedly connected to the piston, so as to permit relative rotation of the upper end of upper link 5 about the axis $O_c$ of piston pin 7. As shown in FIG. 1A, the lower link 4 is comprised of a main lower-link portion 4*a* and a cap portion 4*b* bolted to the main lower-link portion in such a manner as to sandwich the crank pin between the half-round section of main lower-link portion 4*a* and the half-round section of cap portion 4*b*. The lower end of upper link 5 and main lower-link portion 4*a* are connected to each other by means of a connecting pin 6, so as to permit relative rotation of the lower end of upper link 5 about the axis $O_d$ of connecting pin 6 and relative rotation of main lower-link portion 4*a* about the axis $O_d$ of connecting pin 6. By way of the half-round sections of main lower-link portion 4*a* and cap portion 4*b* bolted to each other, lower link 4 is supported on the associated crank pin 3 so as to permit relative rotation of lower link 4 about the axis $O_e$ of crank pin 3. The main lower-link portion 4*a* and a control link (or a third link) 10 are connected to each other by means of a connecting pin 11, so as to permit relative rotation of main-lower-link portion 4*a* about the axis $O_f$ of connecting pin 11 and relative rotation of control link 10 about the axis $O_f$ of connecting pin 11. In FIG. 1A, a part denoted by reference sign 12 is a control shaft which is rotatably supported on the cylinder block. In the shown embodiment, control shaft 12 is composed of a large-diameter control-shaft portion 12*a* and a small-diameter control-shaft portion 12*b* fixed to each other. The axis $O_a$ of large-diameter control-shaft portion 12*a* is eccentric to the axis $O_b$ of small-diameter control-shaft portion 12*b* by a predetermined distance. The lower end of control link 10 is fitted to the large-diameter control-shaft portion 12*a* so as to permit oscillating motion of the control link 10 about the axis $O_a$ of large-diameter control link 12*a*. Small-diameter control-shaft portion 12*b* of control shaft 12 is rotatably supported on the cylinder block. The small-diameter control-shaft portion 12*b* is rotated or driven by a so-called compression-ratio control actuator (not shown) depending on engine operating conditions such as engine speed and load, such that the axis $O_a$ of large-diameter control-shaft portion 12*a* revolves on the axis $O_b$ of small-diameter control-shaft portion 12*b* to cause relative displacement of the axis $O_a$ of large-diameter control-shaft portion 12*a* to the cylinder block and the large-diameter control-shaft portion 12*a* is kept at a given angular position with respect to the axis $O_b$ of small-diameter control-shaft portion 12*b*, and thus the compression ratio is controlled to a desired ratio based on the engine operating conditions. As shown in FIG. 1A, on the assumption that the rotation center of crankshaft 1, that is, the axis of crank journal 2 is defined as the origin O, a directed line $O_x$ parallel to a direction (major and minor side thrust directions) perpendicular to the piston pin 7 and a trace line 1 of reciprocating motion of the axis $O_c$ of piston pin 7 as viewed from the direction of the axis $O_c$ of piston pin 7 is taken as an x-axis, whereas a directed line $O_y$ parallel to the previously-noted trace line 1 of reciprocating motion of the axis $O_c$ of piston pin 7 is taken as a y-axis. The directed lines Ox and Oy intersect at a right angle at the origin O. The trace line 1 of reciprocating motion of the axis $O_c$ of piston pin 7 generally corresponds to the cylinder center line of the cylinder 9. In addition to the above, assuming that the direction of rotation of crankshaft 1 is defined as a counterclockwise direction as viewed from the front end of the engine, in the multiple-link type reciprocating internal combustion engine of the embodiment, note that an x-coordinate of the previously-noted trace line 1 passing through the axis $O_c$ of piston pin 7 is set to a negative value, whereas an x-coordinate of the axis $O_a$ of large-diameter control-shaft portion 12*a*, whose axis ($O_a$) serves as a pivot of oscillating motion of control link 10, is set to a positive value. In more detail, assuming that the distance $|OO_e|$ between the rotation center O of crankshaft 1 (exactly, the axis O of crank journal 2) and the axis $O_e$ of crank pin 3 is defined as L1, the distance $|O_eO_f|$ between the axis $O_e$ of crank pin 3 and the axis (which will be hereinafter referred to as a "first axis") $O_f$ of connecting pin 11 is defined as L2, the length of control link 10 is defined as L3, the distance $|O_eO_d|$ between the axis $O_e$ of crank pin 3 and the axis (which will be hereinafter referred to as a "second axis") $O_d$ of connecting pin 6 is defined as L4, the distance $|O_fO_d|$ between the first axis $O_f$ and the second axis $O_d$ is defined as L5, the length of upper link 5 is defined as L6, the coordinates of the axis $O_a$ of large-diameter control-shaft portion 12*a*, whose axis ($O_a$) serves as the pivot of oscillating motion of control link 10, are defined as (XC, YC), and the x-coordinate of the trace line 1 of reciprocating motion of the axis $O_c$ of piston pin 7 is defined as x4, these dimensions (L1, L2, L3, L4, L5, L5, L6), the coordinates (XC, YC) of the axis $O_a$ of large-diameter control-shaft portion 12*a*, and the x-coordinate x4 of the trace line 1 of reciprocating motion of the axis $O_c$ of piston pin 7 are set to satisfy the following predetermined ratio.

$$L1:L2:L3:L4:L5:L6:XC:YC:x4 \approx$$

$$1:2.4:2.65 \sim 3.5:0.69:3.0 \sim 3.4:3.3 \sim 3.55:3.2 \sim 3.55: -2 \sim$$

$$-1.35: -1 \sim -0.6$$

As can be appreciated, the coordinates (XC, YC) of the axis (or the pivot) $O_a$ vary depending on the angular position of control shaft 12 (exactly, the angular position of small-diameter control-shaft portion 12*b* driven by the compression-ratio control actuator), however, in the multiple-link type reciprocating engine of the embodiment, the dimensions (L1, L2, L3, L4, L5, L5, L6), the coordinates (XC, YC) of the axis $O_a$ of large-diameter control-shaft portion 12*a*, and the x-coordinate x4 of the trace line 1 of reciprocating motion of the piston-pin axis $O_c$ are set to satisfy the above predetermined ratio, when the angular position of control shaft 12 is within a controlled range.

Figure 2:
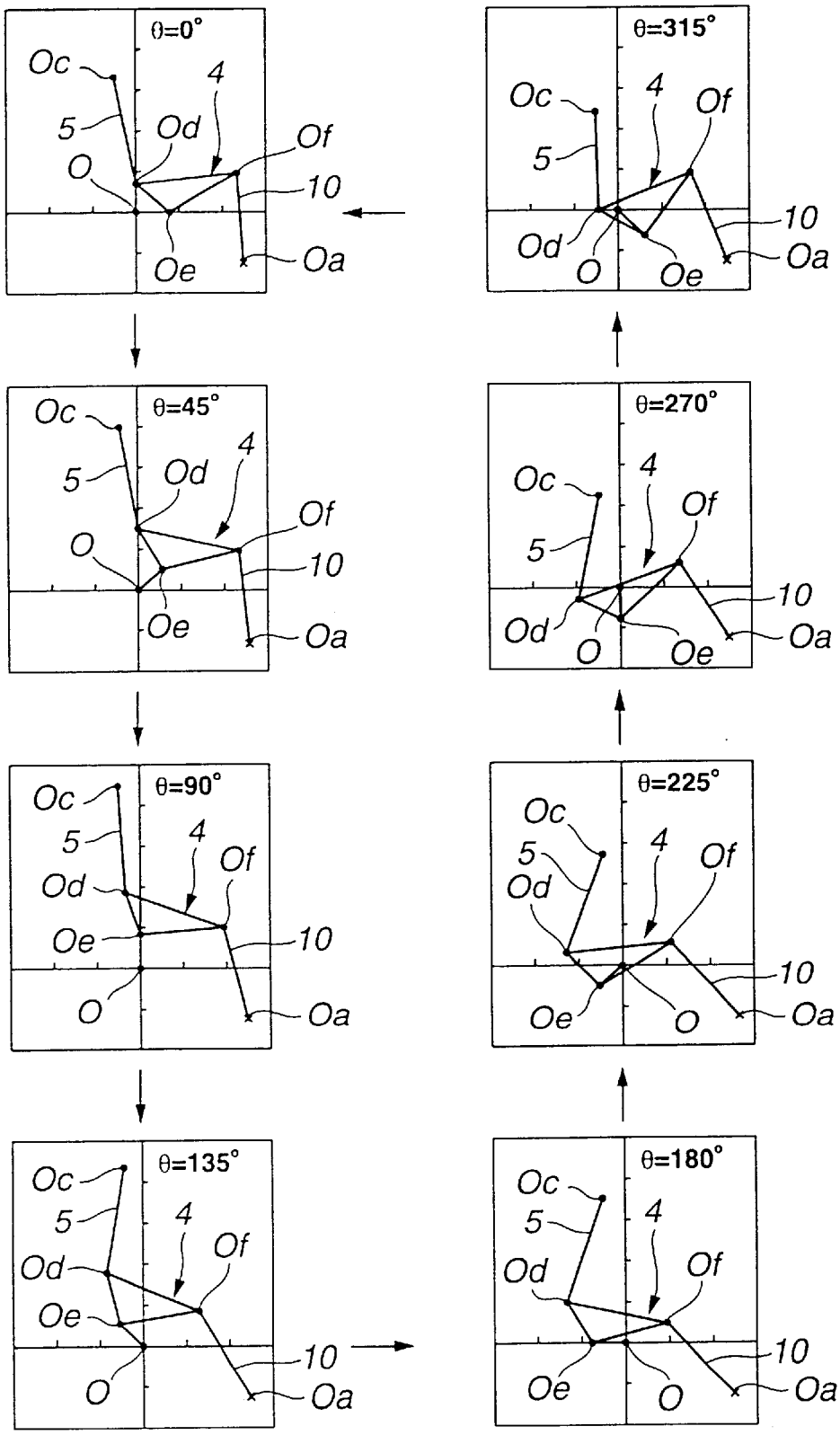
FIG. 2 is a diagram showing a series of motions of the links at various angular positions of the crankshaft.
Figure 3:
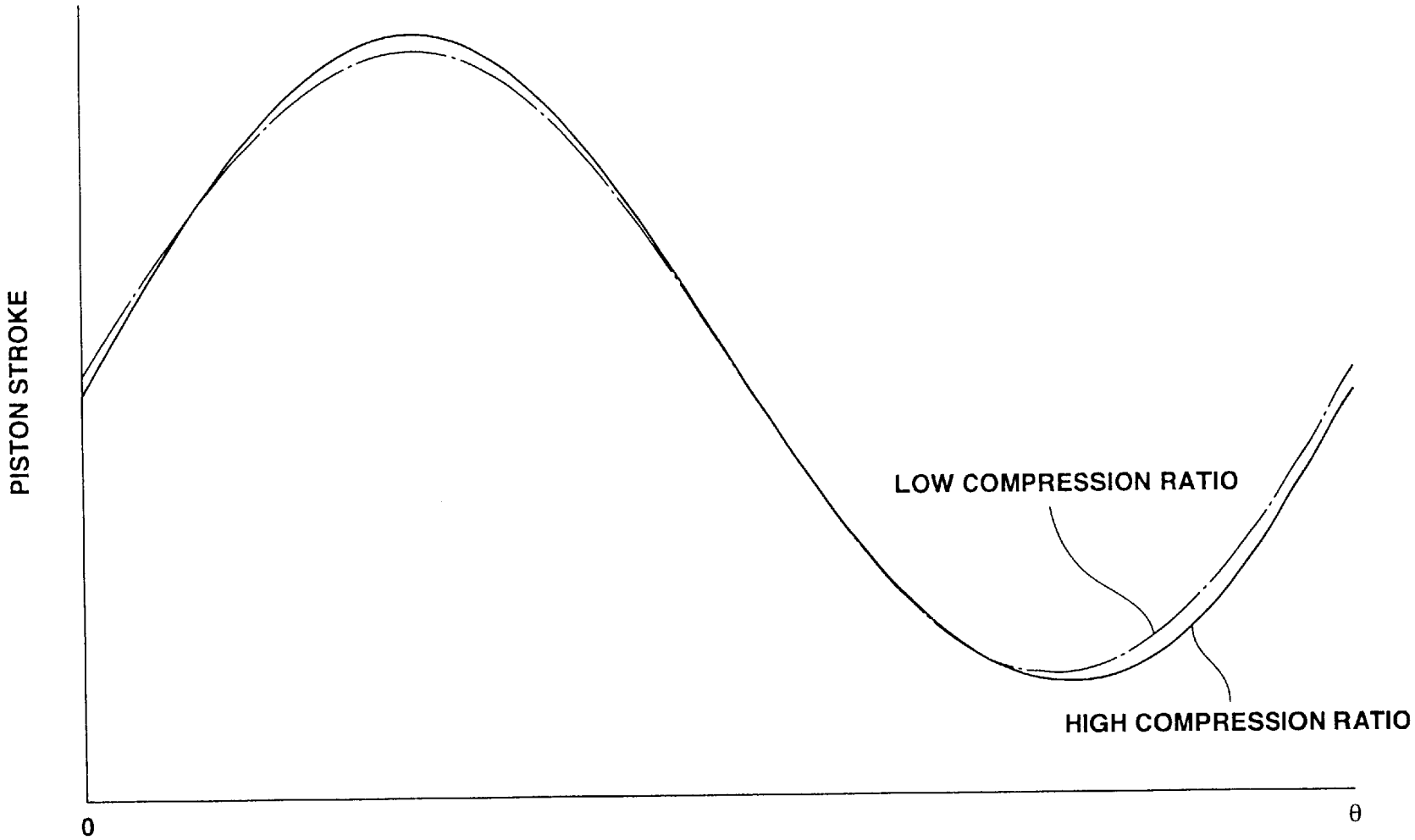
FIG. 3 is a comparison graph showing both a piston-stroke characteristic curve obtained at a high compression ratio and a piston-stroke characteristic curve obtained at a low compression ratio, in the multiple-link type reciprocating engine of the embodiment.
Figure 4:
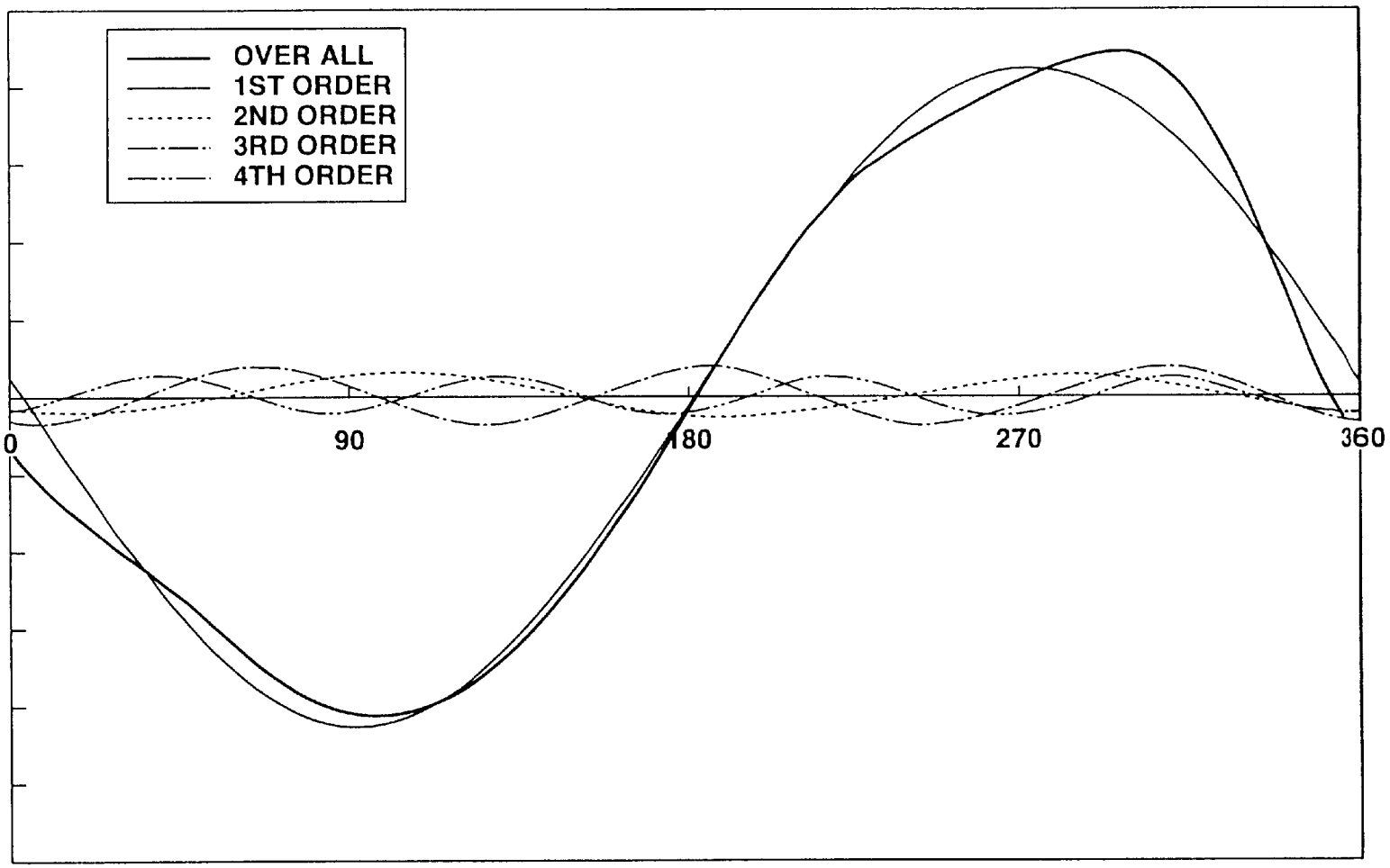
FIG. 4 is a graph illustrating piston acceleration variations at the high compression ratio and the amplitude of each of piston-acceleration components having different orders, in the multiple-link type reciprocating engine of the embodiment.
Figure 5:
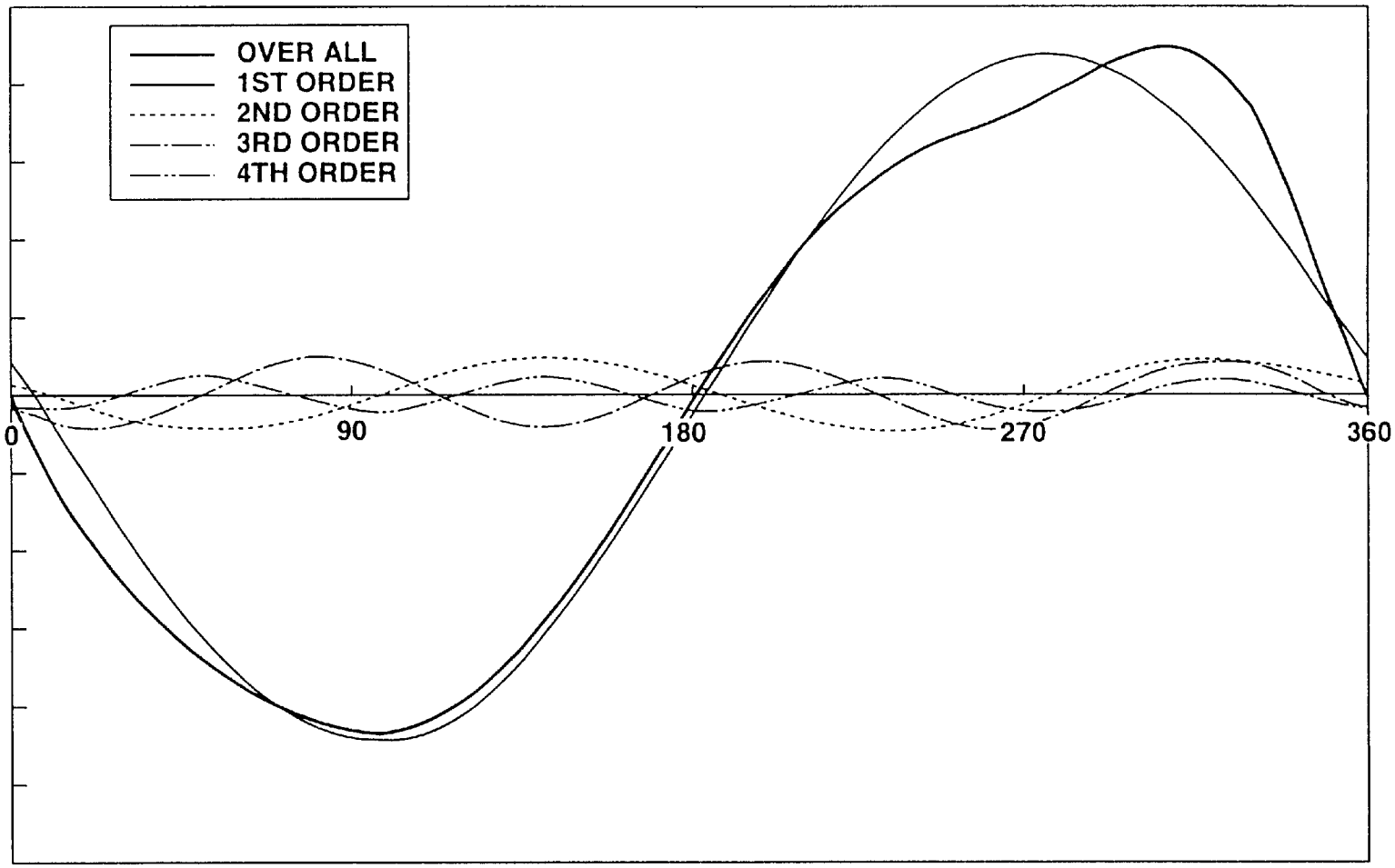
FIG. 5 is a graph illustrating piston acceleration variations at the low compression ratio and the amplitude of each of piston-acceleration components having different orders, in the multiple-link type reciprocating engine of the embodiment.
Figure 9:
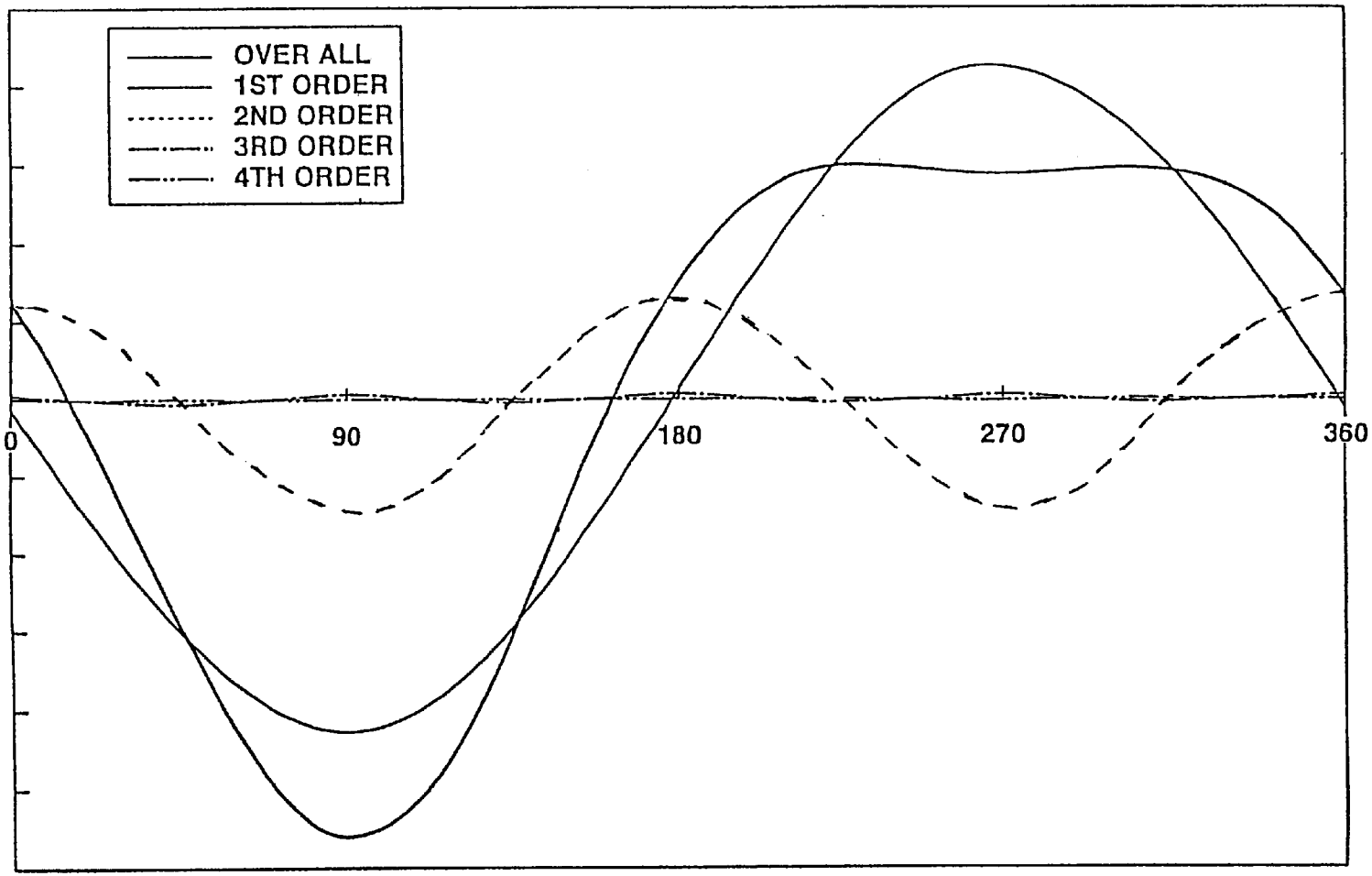
FIG. 9 is a graph illustrating piston acceleration variations and the amplitude of each of piston-acceleration components having different orders, in the single-link type reciprocating engine.

With the previously-described multi-link arrangement of the embodiment, the piston moves up and down in the associated cylinder through crank pin 3, lower link 4, upper link 5 and piston pin 7, as the crankshaft rotates. The control link 10, mechanically linked to lower link 4, oscillates about the axis $O_a$ of large-diameter control-shaft portion 12*a*. For a clear understanding of a series of motions of the linkages (upper link 5, lower link 4, and control link 10), FIG. 2 shows the attitude of each of links 4, 5, and 10 at 0°, 45°, 90°, 135°, 180°, 225°, 270°, and 315° of crankshaft rotation (or crank angle θ). Additionally, in the multiple-link type reciprocating engine of the embodiment, the axis $O_a$ of large-diameter control-shaft portion 12*a* revolves on the axis $O_b$ of small-diameter control-shaft portion 12*b* by driving the small-diameter control-shaft portion 12*b* by the compression-ratio control actuator, and as a result the center (the pivot axis $O_a$) of oscillating motion of control link 10 is shifted or displaced relative to the engine body (that is, the engine block) and thus shifted or displaced relative to the center-of-rotation O of crankshaft 1. As a consequence, the piston stroke varies, with the result that a compression ratio of each of the engine cylinders can be variably controlled. FIG. 3 shows variations in each of the piston strokes obtained when the small-diameter control-shaft portion 12*b* of control shaft 12 is rotated to and held at an angular position corresponding to a high compression ratio (see the characteristic curve indicated by the solid line in FIG. 3) and when the small-diameter control-shaft portion 12*b* of control shaft 12 is rotated to and held at an angular position corresponding to a low compression ratio (see the characteristic curve indicated by the one-dotted line in FIG. 3). Each of the piston strokes obtained the high and low compression ratios is the y-coordinate of the axis $O_c$ of piston pin 7. On the other hand, FIG. 4 shows variations in piston acceleration and the amplitude of each of piston-acceleration components having different orders, obtained at the aforementioned high compression ratio, whereas FIG. 5 shows variations in piston acceleration and the amplitude of each of piston-acceleration components having different orders, obtained at the aforementioned low compression ratio. In the characteristic curves shown in FIGS. 4 and 5, the heavy solid line indicates the change in the piston acceleration of the multiple-link type reciprocating engine of the embodiment, the thin solid line indicates the change in the first-order piston acceleration corresponding to the first-order vibration component of the vibrating system of reciprocating motion of the piston, synchronizing rotary motion of crankshaft 1, the broken line indicates the change in the second-order piston acceleration corresponding to the second-order vibration component of the vibrating system of reciprocating motion of the piston, the one-dotted line indicates the change in the third-order piston acceleration corresponding to the third-order vibration component of the vibrating system of reciprocating motion of the piston, and the two-dotted line indicates the change in the fourth-order piston acceleration corresponding to the fourth-order vibration component of the vibrating system of reciprocating motion of the piston. As can be seen from the characteristic curves shown in FIG. 4, when the small-diameter control-shaft portion 12*b* is held at the angular position corresponding to the high compression ratio, on the assumption that in the test results of FIG. 4 the amplitude of 1st-order piston-acceleration component involved in the first-order vibrating system is regarded as a reference (100%), the higher-order vibration components, namely the 2nd-order and 3rd-order, and 4th-order acceleration components, are reduced or suppressed to a value less than or equal to 10% of the amplitude of the 1st-order acceleration component (1st-order vibration component). That is, in the multiple-link type reciprocating engine of the embodiment, by way of proper setting of dimensions (L1, L2, L3, L4, L5, L6), shapes, and layout and relative positions of the links (4, 5, 10, 12), including the coordinates (XC, YC) of the displaceable axis $O_a$ of large-diameter control-shaft portion 12*a* and the x-coordinate x4 of the trace line 1 of reciprocating motion of the piston-pin axis $O_c$, it is possible to adequately attenuate vibrations and noises which may occur due to these higher-order vibration components (higher-order acceleration components). As can be seen from the characteristic curves of FIG. 5, the amplitudes of the higher-order vibration components shown in FIG. 5 (obtained at the low compression ratio) tends to be slightly larger than those shown in FIG. 4 (obtained at the high compression ratio). However, on the assumption that in the test results of FIG. 5 the amplitude of 1st-order piston-acceleration component involved in the first-order vibrating system is regarded as a reference (100%), the higher-order vibration components, namely the 2nd-order and 3rd-order, and 4th-order acceleration components, are reduced or suppressed to a value less than or equal to 10% of the amplitude of the 1st-order acceleration component (1st-order vibration component). Exactly speaking, the 2nd-order acceleration component (2nd-order vibration component) is reduced or suppressed to a value less than or equal to 7% of the amplitude of the 1st-order vibration component, the 3rd-order acceleration component (3rd-order vibration component) is reduced or suppressed to a value less than or equal to 9% of the amplitude of the 1st-order vibration component, and the 4th-order acceleration component (4th-order vibration component) is reduced or suppressed to a value less than or equal to 7% of the amplitude of the 1st-order vibration component. Therefore, even at the low compression ratio (FIG. 5) as well as at the high compression ratio (FIG. 4), it is possible to satisfactorily effectively attenuate vibrations and noises which may occur due to the higher-order vibration components (higher-order acceleration components). As can be appreciated from comparison between the characteristic curves of FIGS. 4 and 5 obtained in the multiple-link type reciprocating engine of the embodiment and the characteristic curves of FIG. 9 obtained in the single-link type reciprocating engine, the multiple-link type reciprocating engine of the embodiment can largely attenuate the 2nd-order vibrating system component of reciprocating motion of the piston, synchronizing crankshaft rotation, while realizing the same piston stroke and engine-cylinder height (which height is defined as a y-coordinate of the axis $O_c$ of piston pin 7 at TDC of the piston when the axis of crank journal 2 is defined as the origin O) as the single-link type reciprocating engine having the characteristics shown in FIG. 9. In other words, according to the multiple-link type reciprocating engine of the embodiment, the amplitude of the 2nd-order vibration component of reciprocating motion of the piston synchronizing crankshaft rotation can be reduced to or suppressed to a low level substantially corresponding to the amplitude of the 3rd-order vibration component of reciprocating motion of the piston synchronizing crankshaft rotation. Therefore, it is possible to effectively reduce the 2nd-order vibrations which may occur due to the 2nd-order piston-acceleration component of reciprocating motion of the piston, synchronizing crankshaft rotation, and consequently to adequately suppress booming noise in the vehicle compartment arising from the 2nd-order vibration component, without increasing the overall height of the engine. In a reciprocating engine having a variable compression-ratio mechanism, generally, the engine is operated at a high compression ratio in low- and middle-speed ranges, and operated at a low compression ratio in a high-speed range. In the multiple-link type reciprocating engine of the embodiment, in which the compression ratio is changeable by varying the piston stroke, as shown in FIGS. 4 and 5, the amplitude of each of piston-acceleration components having the 1st-order, 2nd-order, 3rd-order, and 4th-order also varies depending on the controlled compression ratio based on the engine operating conditions. For the reasons set forth above, in the multiple-link type reciprocating engine of the embodiment, the amplitudes of the higher-order piston-acceleration components obtained at low- and middle-speed operations (at a high compression ratio) during which it is desirable to be free of noise as much as possible, are set to be smaller than those obtained at high-speed operations (at a low compression ratio). In particular, the amplitude of the second-order vibration component of the vibrating system of reciprocating motion of the piston, produced when the pivot $O_a$ of the third link is kept at an angular position corresponding to a first compression ratio (a high compression ratio suitable for low- and mid-speed ranges), is less than the amplitude of the second-order vibration component of the vibrating system of reciprocating motion of the piston, produced when the pivot of the third link is kept at an angular position corresponding to a second compression ratio (a low compression ratio suitable for a high-speed range).

Figure 6B:
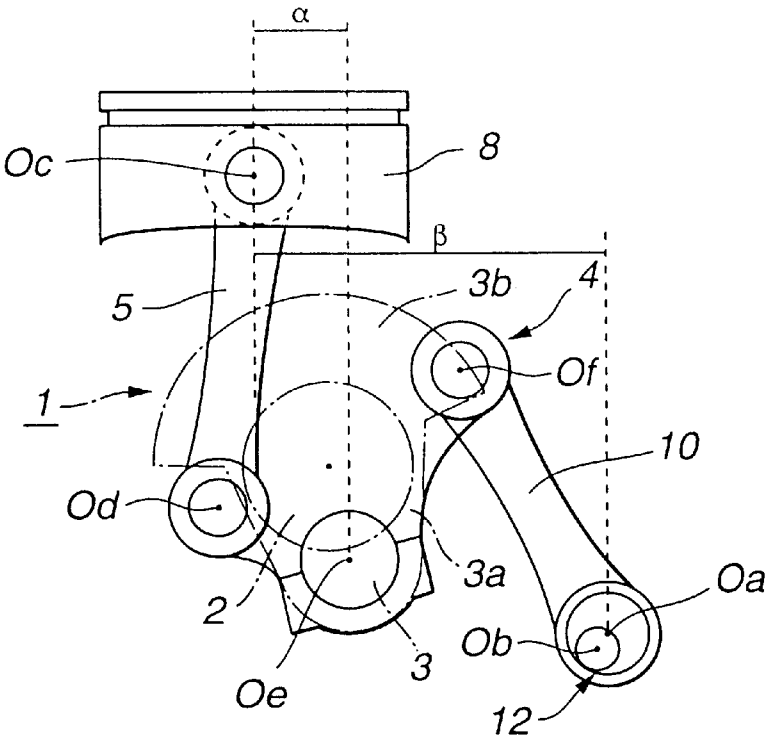
FIG. 6B is an assembled view showing the attitude of the links near BDC.
Figure 6A:
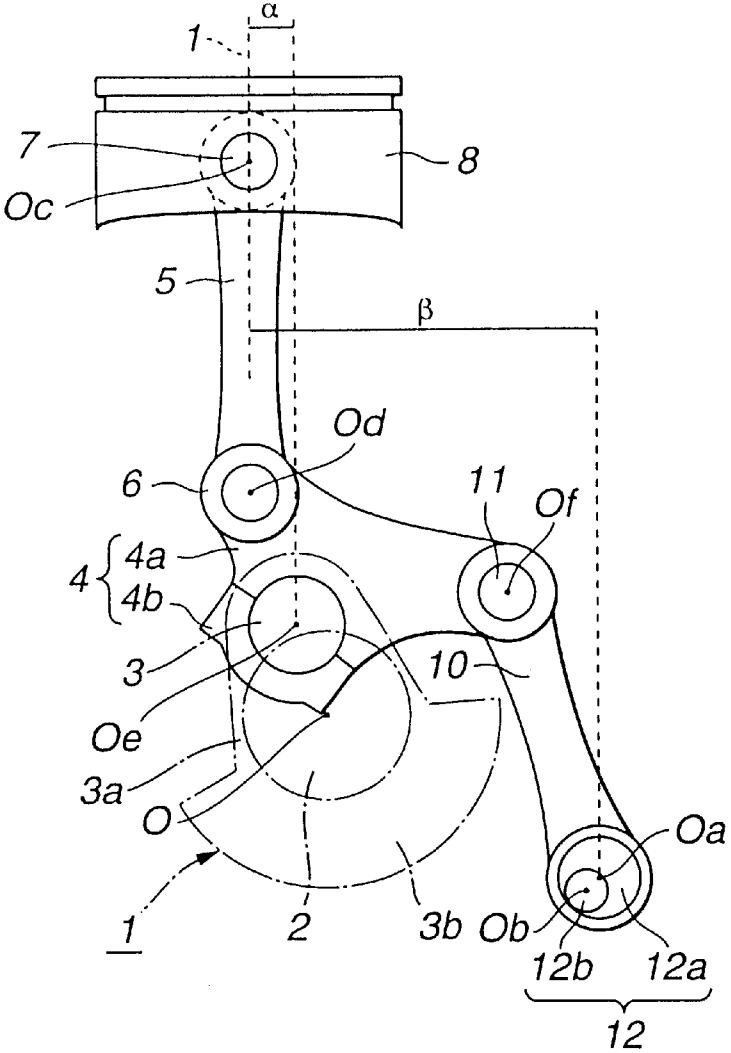
FIG. 6A is an assembled view showing the attitude of the links near TDC.
Figure 7:
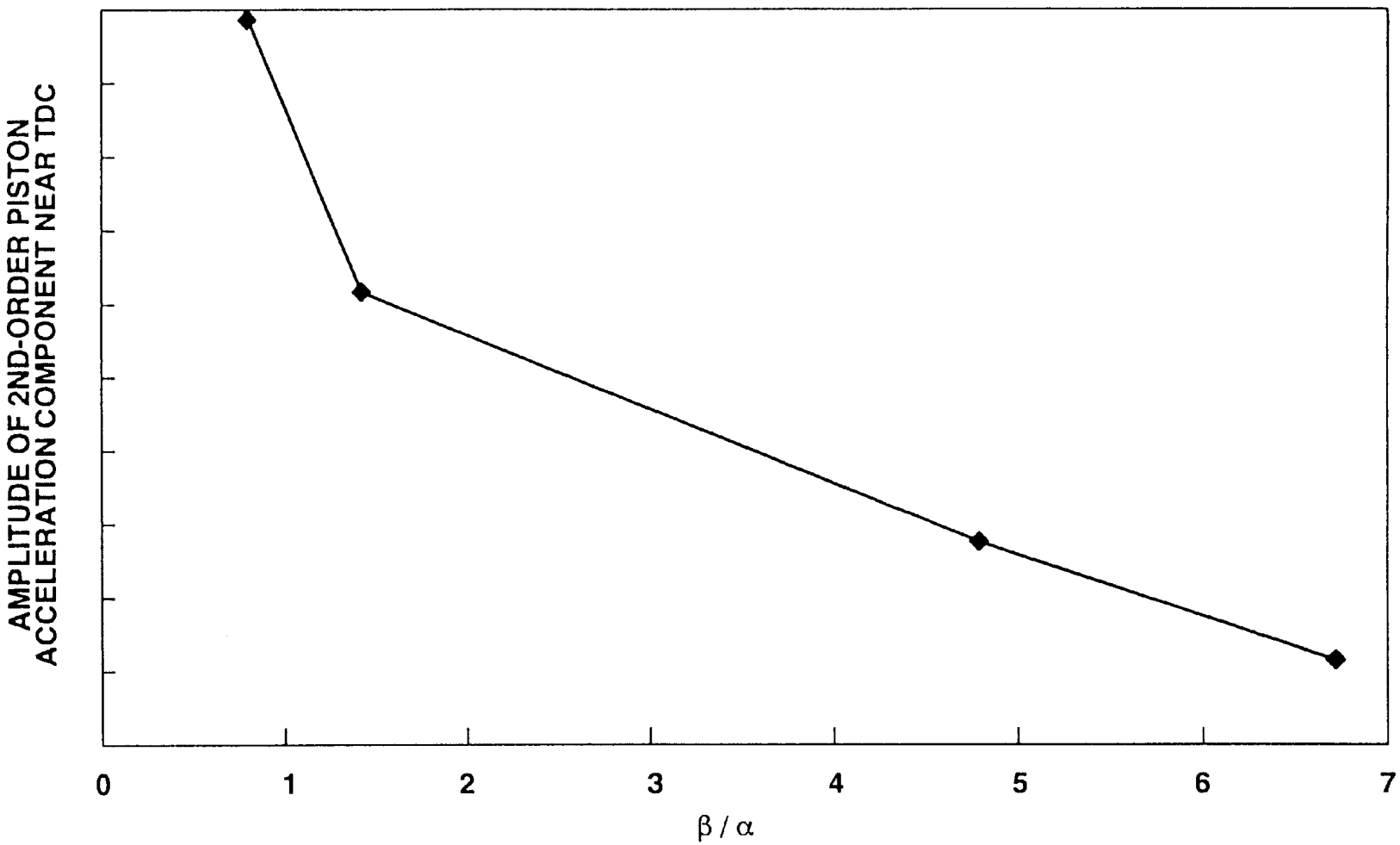
FIG. 7 is a graph showing the relationship between the amplitude of the second-order piston-acceleration component near TDC and the ratio $\beta/\alpha$ of the distance $\beta$ (=the distance from axis $O_a$ to line 1) between two axes $O_a$ and $O_c$ in the x-axis direction to the distance $\alpha$ (=the distance from axis $O_e$ to line 1) between two axes $O_e$ and $O_c$ in the x-axis direction.
Figure 8:
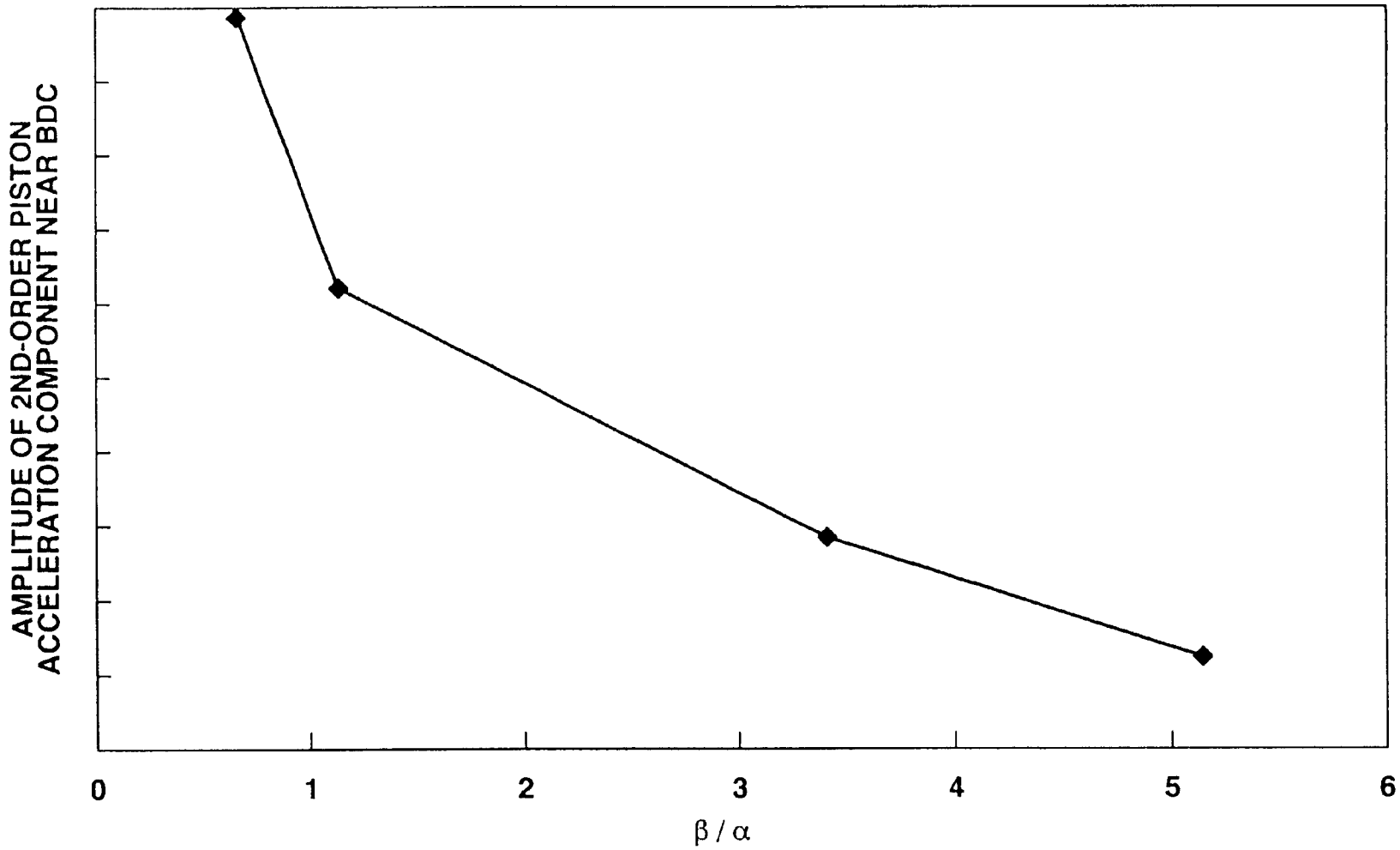
FIG. 8 is a graph showing the relationship between the amplitude of the second-order piston-acceleration component near BDC and the ratio $\beta/\alpha$.

FIGS. 6A shows the attitude of the links (5, 4, 10) near TDC of the piston 8, while FIG. 6B shows the attitude of the links near BDC. As is generally known, when the piston reaches a position substantially corresponding to the TDC or a position substantially corresponding to the BDC, the piston acceleration becomes the maximum piston-acceleration value. The load acting on control shaft 12 through piston pin 7, upper link 5, lower link 4, and control link 10 also becomes the greatest value. In addition to the above, when the piston is near the TDC on the compression stroke, a reaction (a push-back force) which results when combustion pressure is applied onto the piston crown also exerts on the control shaft 12. The load acting on control shaft 12 through control link 10 acts practically on the axis $O_a$ of large-diameter control-shaft portion 12*a*, but serves as a torque that rotates the control shaft 12, since the axis $O_a$ of large-diameter control-shaft portion 12*a* is eccentric to the axis $O_b$ of small-diameter control-shaft portion 12*b*. If the previously-noted torque, created due to the load applied from piston pin 7 through upper link 5, lower link 4, and control link 10 to control shaft 12, becomes greater than a holding torque of the compression-ratio control actuator used to hold the control shaft at a desired angular position based on engine operating conditions including at least engine speed, there is a possibility that the control shaft 12 will unintendedly rotate from its desired, controlled angular position based on the current engine operating conditions, thus resulting in a deviation from the desired compression ratio based on the current engine operating conditions. To avoid such a deviation from the desired compression ratio, arising from (a) the load transmitted from the piston pin through the upper link, the lower link, and the control link and exerting on the control shaft during the reciprocating motion of piston 8 and/or (b) the reaction force which results when combustion pressure is applied onto the piston crown when the piston is near the TDC on the compression stroke, in the multiple-link type reciprocating engine of the embodiment, at least when the piston is at a position substantially corresponding to either the TDC or the BDC at which the load exerting on control shaft 12 through pins and links 7, 5, 6, 4, 11, and 10 becomes the greatest value, the distance a from the axis $O_e$ of crank pin 3 to the trace line 1 of reciprocating motion of the piston-pin axis $O_c$, that is, the distance $\alpha$ between the axis $O_e$ of crank pin 3 and the axis $O_c$ of piston pin 7 in the x-axis direction, is set to be shorter than the distance $\beta$ from the axis $O_a$ of large-diameter control-shaft portion 12*a* to the trace line 1 of reciprocating motion of the piston-pin axis $O_c$, that is, the distance $\beta$ between the two axes $O_a$ and $O_c$ in the x-axis direction. That is, the relationship between the two distances $\alpha$ and $\beta$ is predetermined to satisfy the inequality $\alpha<\beta$, so as to effectively reduce the load applied to the control shaft 12 by way of the proper setting of the leverage or lever ratio, that is, the ratio $\beta/\alpha$ of the distance $\beta$ to the distance $\alpha$. By the proper setting of the leverage, i.e., the ratio $\beta/\alpha$, it is possible to effectively reduce a holding torque value of the compression-ratio control actuator used to hold the control shaft at a desired angular position based on engine operating conditions. As can be seen from the graphs shown in FIGS. 7 and 8, respectively showing the relationship between the ratio $\beta/\alpha$ and the amplitude of the 2nd-order piston-acceleration component near TDC and the relationship between the ratio $\beta/\alpha$ and the amplitude of the 2nd-order piston-acceleration component near BDC, the amplitude of the 2nd-order piston-acceleration component tends to rise rapidly when the ratio $\beta/\alpha$ is reduced to below "1". The results of FIGS. 7 and 8 were arithmetically assured by the inventors of the present invention. From the viewpoint of effective reduction in the 2nd-order piston-acceleration component (effective attenuation in 2nd-order vibration component), it is preferable to set the ratio $\beta/\alpha$ to satisfy the inequality $\beta/\alpha>1$ (in other words, $\beta>\alpha$).

Furthermore, as described previously, the x-coordinate of axis $O_a$ of large-diameter control-shaft portion 12*a*, which axis $O_a$ serves as the center of oscillating motion of control link 10, is set to a positive value, and additionally the x-coordinate of the trace line 1 of reciprocating motion of the piston-pin axis $O_c$ is set to a negative value. The downward force component (functioning as a driving source for the internal combustion engine), exerting on piston 8 when combustion pressure is applied onto the piston crown, can effectively act on crank pin 3. The downward force component exerting on piston 8 when combustion pressure is applied will be hereinafter referred to as a "downward combustion load". A combination of setting the x-coordinate of axis $O_a$ of large-diameter control-shaft portion 12*a* to a positive value and setting the x-coordinate of the trace line 1 of reciprocating motion of the piston-pin axis $O_c$ to a negative value contributes to a lower overall height of the engine, that is, a reduction in a width dimension taken in the x-axis direction of the engine, thus reducing the size and weight of the engine. In contrast to the above, if the x-coordinate of the axis $O_a$ of large-diameter control-shaft portion 12*a* and the x-coordinate of the trace line 1 of reciprocating motion of the piston-pin axis $O_c$ are both set as positive values, there is a tendency for the deviation between the x-coordinate of the trace line 1 of reciprocating motion of the piston-pin axis $O_c$ and the x-coordinate of the crankpin axis $O_e$ during the downstroke of piston 8 (that is, when the y-coordinate of the crankpin axis $O_e$ is decreasing) to become greater. In this case, there are two demerits. First, it is impossible to effectively satisfactorily act the downward combustion load exerting on the piston upon the crank pin 3 owing to the comparatively great deviation between the x-coordinate of the trace line 1 of reciprocating motion of the piston-pin axis $O_c$ and the x-coordinate of the crankpin axis $O_e$ during the piston downstroke. Second, in order to assure a remarkably-increased difference between the distance $\beta$ and the distance $\alpha$, in other words, to assure a greater ratio $\beta/\alpha$, the positive x-coordinate XC of the axis $O_a$ of large-diameter control-shaft portion 12*a* has to be set at a greater positive value such that the axis $O_a$ is located greatly apart from the origin O in the positive x-direction. This results in an increase in the width dimension of the engine. Alternatively, if the x-coordinate of the axis $O_a$ of large-diameter control-shaft portion 12*a* and the x-coordinate of the trace line 1 of reciprocating motion of the piston-pin axis $O_c$ are both set as negative values, there is a tendency for the deviation between the x-coordinate of the trace line 1 of reciprocating motion of the piston-pin axis $O_c$ and the x-coordinate of the crankpin axis $O_e$ during the piston downstroke to become less. Thus, it is possible to effectively act the previously-noted downward combustion load upon the crank pin 3 owing to the comparatively less deviation. However, in order to assure a remarkably-increased difference between the two distances $\beta$ and $\alpha$, and to assure a greater ratio $\beta/\alpha$, the negative x-coordinate XC of the axis $O_a$ of large-diameter control-shaft portion 12*a* has to be set at a smaller negative value such that the axis $O_a$ is located greatly apart from the origin O in the negative x-direction, thus resulting in an increase in the width dimension of the engine. In lieu thereof, if the x-coordinate of the axis $O_a$ of large-diameter control-shaft portion 12*a* is set to a negative value and additionally the x-coordinate of the trace line 1 of reciprocating motion of the piston-pin axis $O_c$ is set to a positive value, there is a tendency for the deviation between the x-coordinate of the trace line 1 of reciprocating motion of the piston-pin axis $O_c$ and the x-coordinate of the crankpin axis $O_e$ during the piston downstroke to become greater. In such a case, it is impossible to effectively act the previously-noted downward combustion load upon the crank pin 3 owing to the comparatively great deviation.

In the shown embodiment, in order to variably control the piston stroke (the compression ratio of the engine), the axis $O_a$ of large-diameter control-shaft portion 12*a* of control shaft 12 is pivotable with respect to the engine body (the engine block) and the third link (control link 10) is mechanically linked to main lower-link portion 4*a* of lower link 4. In lieu thereof, to provide the same effect (that is, variable piston stoke control), it will be appreciated that the axis $O_a$ of large-diameter control-shaft portion 12*a* of control shaft 12 is pivotable with respect to the engine body and the third link (control link 10) may be mechanically linked to upper link 5.

The entire contents of Japanese Patent Application No. P2000-37380 (filed Feb. 16, 2000) is incorporated herein by reference.

While the foregoing is a description of the preferred embodiment carried out the invention, it will be understood that the invention is not limited to the particular embodiment shown and described herein, but that various changes and modifications may be made without departing from the scope or spirit of this invention as defined by the following claims.

What is claimed is:

1. A multiple-link type reciprocating internal combustion engine, comprising:

a piston movable through a stroke in the engine and having a piston pin;

a crankshaft changing reciprocating motion of the piston into rotating motion and having a crank pin;

a linkage comprising:

an upper link connected to the piston pin;

a lower link connecting the upper link to the crank pin; and a third link pivoted at one end to a body of the engine and connected at its other end to either of the upper and lower links to permit oscillating motion of the third link on the body of the engine;

the upper link, the lower link, and the third link being dimensioned and laid out so that an amplitude of a second-order vibration component of a vibrating system of reciprocating motion of the piston, synchronizing rotary motion of the crankshaft, is reduced to below a predetermined threshold value.

2. A multiple-link type reciprocating internal combustion engine, comprising:

a piston movable through a stroke in the engine and having a piston pin;

a crankshaft changing reciprocating motion of the piston into rotating motion and having a crank pin;

a linkage comprising:

an upper link connected to the piston pin;

a lower link connecting the upper link to the crank pin; and a third link pivoted at one end to a body of the engine and connected at its other end to either of the upper and lower links to permit oscillating motion of the third link on the body of the engine;

the upper link, the lower link, and the third link being dimensioned and laid out so that an amplitude of a second-order vibration component of a vibrating system of reciprocating motion of the piston, synchronizing rotary motion of the crankshaft, is generally equal to an amplitude of a third-order vibration component of the vibrating system.

3. The multiple-link type reciprocating internal combustion engine as claimed in claim 1, wherein a pivot of oscillating motion of the third link is displaceable with respect to the body of the engine, to vary a compression ratio of the engine.

4. The multiple-link type reciprocating internal combustion engine as claimed in claim 3, wherein the amplitude of the second-order vibration component of the vibrating system of reciprocating motion of the piston, produced when the pivot of the third link is kept at an angular position corresponding to a first compression ratio, is less than the amplitude of the second-order vibration component of the vibrating system of reciprocating motion of the piston, produced when the pivot of the third link is kept at an angular position corresponding to a second compression ratio less than the first compression ratio.

5. The multiple-link type reciprocating internal combustion engine as claimed in claim 1, wherein a distance from an axis of the crank pin to a trace line of reciprocating motion of an axis of the piston pin is shorter than a distance from a pivot of oscillating motion of the third link to the trace line of reciprocating motion of the axis of the piston pin, at least when the piston is near top dead center.

6. The multiple-link type reciprocating internal combustion engine as claimed in claim 1, wherein a distance from an axis of the crank pin to a trace line of reciprocating motion of an axis of the piston pin is shorter than a distance from a pivot of oscillating motion of the third link to the trace line of reciprocating motion of the axis of the piston pin, at least when the piston is near bottom dead center.

7. The multiple-link type reciprocating internal combustion engine as claimed in claim 1, wherein, when a center of rotation of the crankshaft is defined as an origin O, a directed line Ox parallel to a direction perpendicular to the piston pin and a trace line of reciprocating motion of an axis of the piston pin as viewed from a direction of the axis of the piston pin is taken as an x-axis, a directed line Oy parallel to the trace line of reciprocating motion of the axis of the piston pin is taken as a y-axis, the directed lines Ox and Oy intersecting at a right angle at the origin O, and a direction of rotation of the crankshaft is defined as a counterclockwise direction as viewed from a front end of the engine, an x-coordinate of a pivot of oscillating motion of the third link is set to a positive value and an x-coordinate of the trace line of reciprocating motion of the axis of the piston pin is set to a negative value.

8. The multiple-link type reciprocating internal combustion engine as claimed in claim 7, which further comprises a first connecting portion via which the lower link and the third link are connected to each other to permit relative rotation of the lower link about an axis of the first connecting portion and relative rotation of the third link about the axis of the first connecting portion and a second connecting portion via which the upper link and the lower link are connected to each other to permit relative rotation of the upper link about an axis of the second connecting portion and relative rotation of the lower link about the axis of the second connecting portion, and wherein the upper link, the lower link, and the third link are dimensioned and laid out, to satisfy a predetermined ratio $$L1:L2:L3:L4:L5:L6:XC:YC:x4 \approx$$

$$1:2.4:2.65 \sim 3.5:0.69:3.0 \sim 3.4:3.3 \sim 3.55:3.2 \sim 3.55: -2 \sim -1.35: -1 \sim -0.6$$

where L1 is a distance between the center of rotation of the crankshaft and an axis of the crank pin, L2 is a distance between the axis of the crank pin and an axis of the first connecting portion, L3 is a length of the third link, L4 is a distance between the axis of the crank pin and an axis of the second connecting portion, L5 is a distance between the axes of the first and second connecting portions, L6 is a length of the upper link, (XC, YC) are coordinates of the pivot of oscillating motion of the third link, and x4 is the x-coordinate of the trace line of reciprocating motion of the axis of the piston pin.

9. The multiple-link type reciprocating internal combustion engine as claimed in claim 1, wherein the predetermined threshold value of the amplitude of the second-order vibration component is set to be less than or equal to 10% of an amplitude of a first-order vibration component of the vibrating system of reciprocating motion of the piston, synchronizing rotary motion of the crankshaft.

10. A multiple-link type reciprocating internal combustion engine, comprising:

a piston movable through a stroke in the engine and having a piston pin;

a crankshaft changing reciprocating motion of the piston into rotating motion and having a crank pin;

a linkage comprising:

an upper link connected to the piston pin;

a lower link connecting the upper link to the crank pin; and a third link pivoted at one end to a body of the engine and connected at its other end to either of the upper and lower links to permit oscillating motion of the third link on the body of the engine;

the upper link, the lower link, and the third link being dimensioned and laid out so that an amplitude of a second-order vibration component of a vibrating system of reciprocating motion of the piston, synchronizing rotary motion of the crankshaft, is reduced to below a predetermined threshold value, while realizing the same piston stroke and engine-cylinder height as a single-link type reciprocating internal combustion engine in which a piston pin and a crank pin are connected to each other by a single link.

11. The multiple-link type reciprocating internal combustion engine as claimed in claim 10, wherein the upper link, the lower link, and the third link are dimensioned and laid out so that the amplitude of the second-order vibration component of the vibrating system of reciprocating motion of the piston, synchronizing rotary motion of the crankshaft, is generally equal to an amplitude of a third-order vibration component of the vibrating system.

12. The multiple-link type reciprocating internal combustion engine as claimed in claim 11, which further comprises means for displacing a pivot of oscillating motion of the third link with respect to the body of the engine, to vary a compression ratio of the engine.

13. The multiple-link type reciprocating internal combustion engine as claimed in claim 12, wherein the amplitude of the second-order vibration component of the vibrating system of reciprocating motion of the piston, produced when the pivot of the third link is kept at an angular position corresponding to a first compression ratio suitable for low- and middle-speed ranges, is less than the amplitude of the second-order vibration component of the vibrating system of reciprocating motion of the piston, produced when the pivot of the third link is kept at an angular position corresponding to a second compression ratio which is suitable for a high-speed range and is less than the first compression ratio.

14. The multiple-link type reciprocating internal combustion engine as claimed in claim 13, wherein a distance from an axis of the crank pin to a trace line of reciprocating motion of an axis of the piston pin is shorter than a distance from a pivot of oscillating motion of the third link to the trace line of reciprocating motion of the axis of the piston pin, at least when the piston is near either of top dead center and bottom dead center.

15. The multiple-link type reciprocating internal combustion engine as claimed in claim 14, wherein, when a center of rotation of the crankshaft is defined as an origin O, a directed line Ox parallel to a direction perpendicular to the piston pin and a trace line of reciprocating motion of an axis of the piston pin as viewed from a direction of the axis of the piston pin is taken as an x-axis, a directed line Oy parallel to the trace line of reciprocating motion of the axis of the piston pin is taken as a y-axis, the directed lines Ox and Oy intersecting at a right angle at the origin O, and a direction of rotation of the crankshaft is defined as a counterclockwise direction as viewed from a front end of the engine, an x-coordinate of a pivot of oscillating motion of the third link is set to a positive value and an x-coordinate of the trace line of reciprocating motion of the axis of the piston pin is set to a negative value.

16. The multiple-link type reciprocating internal combustion engine as claimed in claim 15, which further comprises a first connecting pin portion via which the lower link and the third link are connected to each other to permit relative rotation of the lower link about an axis of the first connecting pin portion and relative rotation of the third link about the axis of the first connecting pin portion and a second connecting pin portion via which the upper link and the lower link are connected to each other to permit relative rotation of the upper link about an axis of the second connecting pin portion and relative rotation of the lower link about the axis of the second connecting pin portion, and wherein the upper link, the lower link, and the third link are dimensioned and laid out, to satisfy a predetermined ratio $$L1:L2:L3:L4:L5:L6:XC:YC:x4 \approx$$

$$1:2.4:2.65 \sim 3.5:0.69:3.0 \sim 3.4:3.3 \sim 3.55:3.2 \sim 3.55: -2 \sim$$

$$-1.35: -1 \sim -0.6$$

where L1 is a distance between the center of rotation of the crankshaft and an axis of the crank pin, L2 is a distance between the axis of the crank pin and an axis of the first connecting pin portion, L3 is a length of the third link, L4 is a distance between the axis of the crank pin and an axis of the second connecting pin portion, L5 is a distance between the axes of the first and second connecting pin portions, L6 is a length of the upper link, (XC, YC) are coordinates of the pivot of oscillating motion of the third link, and x4 is the x-coordinate of the trace line of reciprocating motion of the axis of the piston pin.

17. The multiple-link type reciprocating internal combustion engine as claimed in claim 16, wherein the predetermined threshold value of the amplitude of the second-order vibration component is set to be less than or equal to 10% of an amplitude of a first-order vibration component of the vibrating system of reciprocating motion of the piston, synchronizing rotary motion of the crankshaft.

* * * * *